United States Patent [19]

Iyer

[11] 4,343,664

[45] Aug. 10, 1982

[54] PRODUCTION OF POLYMER BONDED NITRAMINE EXPLOSIVE AND PROPELLANT COMPOSITIONS

[75] Inventor: Sury Iyer, Randolph, N.J.

[73] Assignee: The United States of America as represented by the Secretary of the Army, Washington, D.C.

[21] Appl. No.: 251,635

[22] Filed: Apr. 6, 1981

[51] Int. Cl.[3] ..... C06B 45/22

[52] U.S. Cl. ..... 149/11; 149/19.91; 149/19.92; 149/92; 149/109.6

[58] Field of Search ..... 149/11, 19.9, 19.91, 149/19.92, 92, 109.6

[56] References Cited

U.S. PATENT DOCUMENTS

| | | | |
|---|---|---|---|
| 3,145,528 | 8/1964 | D'Alelio | 149/19.92 |
| 3,203,170 | 8/1965 | D'Alelio | 149/19.91 |
| 4,056,416 | 11/1977 | Franklin et al. | 149/19.91 |
| 4,163,681 | 8/1979 | Rothenstein et al. | 149/11 |

*Primary Examiner*—Leland A. Sebastian

*Attorney, Agent, or Firm*—Nathan Edelberg; Robert P. Gibson; A. Victor Erkkila

[57] ABSTRACT

Polymer bonded nitramine based explosives and propellants are prepared by radiation polymerization of a polymer precurser, such as methyl methacrylate, in mixture with a particulate nitramine, e.g. RDX, wherein the nitramine particles are coated with an effective amount of a liquid polyhydric alcohol for overcoming the action of the nitramine to inhibit or retard such radiation polymerization.

9 Claims, No Drawings

PRODUCTION OF POLYMER BONDED NITRAMINE EXPLOSIVE AND PROPELLANT COMPOSITIONS

GOVERNMENT RIGHTS

The invention described herein may be manufactured, used and licensed by the Government for Government purposes without the payment to me of any royalty therein.

BACKGROUND OF THE INVENTION

This invention relates to a method for producing polymer bonded nitramine explosives and propellants by radiation polymerization.

Polymer bonded cast explosives and propellants usually contain one or more solid explosive or propellant components bonded together in a matrix of a solid polymeric binder. They can be produced by polymerizing a monomer, such as methyl methacrylate, mixed with a particulate explosive or propellant component, by means of a chemical polymerization catalyst, such as an organic peroxide, or by means of high energy radiation, such as x-rays or gamma rays.

Radiation polymerization provides a number of important advantages of the manufacture of polymer bonded explosives and propellants. Thus, it permits the use of lower polymerization temperatures, which increases the safety of working with mixtures containing sensitive explosive and propellant components, and leaves no catalyst residue in the product. Also, the solid explosive/propellant components can be slurried with the liquid monomer and cast in situ in rocket and projectile casings by radiation. Further, granules of the explosive/propellant components can be coated with the liquid monomer, and the coated granules pressed into rocket casings, large caliber projectile casings, shaped charge rounds, etc. and cured to a hard, solid charge by radiation. Since the compositions are devoid of chemical polymerization catalysts, they possess essentially unlimited "pot life", which is a significant advantage in manufacturing operations.

It is known to prepare radiation cured, polymer bonded explosive and propellant compositions containing inorganic oxidizers, such as ammonium nitrate, ammonium perchlorate, and potassium perchlorate (e.g. U.S. Pat. No. 3,145,528), and organic oxidizers such as nitro compounds, e.g. lead styphnate, trinitrotoluene and pentaerythritol tetranitrate (U.S. Pat. No. 4,056,416). Attempts to produce polymer bonded explosive compositions by radiation polymerization in similar manner using nitramine explosive components have not been successful. It is believed that the nitro groups present as nitramines inhibit the polymerization reaction by intercepting the active transients (free radicals).

Accordingly, it is an object of the present invention to provide a process for producing polymer bonded explosives/propellants containing nitramine components by radiation polymerization.

SUMMARY AND DETAILED DESCRIPTION OF THE INVENTION

It has been found that polymer bonded nitramine based explosives/propellants can be obtained when the polymer precursor is radiation polymerized in mixture with a particulate nitramine, wherein the particles of nitramine are provided with a protective coating consisting essentially of a polyhydric alcohol. Although not exactly known, it is believed that the polyhydric alcohol ties up the nitramine groups via hydrogen bonding and thereby renders them inactive for inhibiting the radiation polymerization process.

In accordance with the present invention, polyhydric alcohols generally can be effectively employed to provide a protective coating over the nitramine particles. Suitable polyhydric alcohols include glycerol, ethylene glycol, 1,2-propylene glycol, 1,4-butanediol, polyethylene glycols, polypropylene glycols, and the like. The polyhydric alcohols employed as coating materials should be non-scavengers of electrons or free radicals and should not be soluble in the polymer precursor (monomer). The amount of liquid polyhydric alcohol employed should be sufficient to provide at least a monomolecular thick coating thereof on the nitramine particles. A relatively large amount of polyhydric alcohol would be required for coating a quantity of finely divided nitramine particles processing a large total surface area, while a relatively small amount of polyhydric alcohol would suffice for coating an equal quantity of coarse nitramine particles having a small total surface area. Generally, amounts of polydric alcohol up to about 10% by weight of the nitramine component can be effectively employed. The polyhydric alcohols can be conveniently coated on the nitramine particles by forming a mixture of the nitramine particles and a solution of the polyhydric alcohol in a volatile solvent, such as accetone, and removing the solvent by evaporation.

The present invention can be utilized for preparing polymer bonded explosives and propellant compositions containing nitramine components such as RDX (1,3,5-trinitro-1,3,5-triazacyclohexane), HMX (1,3,5,7-tetranitro-1,3,5,7-tetraazacyclooctane), and tetryl (2,4,6-trinitrophenyl methyl nitramine). Such compositions may contain other components and additives conventionally employed in nitramine based explosives and propellants, including oxidizers such as 2,4,6-trinitrotoluene and ammonium nitrate, carbon black, powdered metals, such as aluminum, plasticizers, etc.

Monomers and other precursors suitable for use in the practice of the present invention are those which can be polymerized by known methods of radiation, such as x-rays, gamma rays, electron beams, etc. Monomers which can thus be radiation polymerized in the practice of the present invention include, for example, acrylate esters, e.g. ethyl acrylate, butyl acrylate, trimethylol propane trimethacrylate, methyl methacrylate, 2-ethylhexyl acrylate, isobornyl methacrylate; vinyl esters, such as vinyl chloride, and vinyl acetate; allyl esters such is allyl acetate, methallyl acetate and allyl methyl succinate; olefines such as ethylene, propylene, and isobutylene; aryl substituted olefines, such as styrene, alpha methyl styrene and vinyl toluene; and esters of dibasic unsaturated acids, such as diethyl maleate, dibutyl maleate. Generally, about 5 to 25 parts by weight of polymer precursor are employed per 75 to 95 parts of coated nitramine particles in the preparation of the novel explosive and propellant compositions of the present invention.

The following examples illustrate specific embodiments of the method of carrying out the process of the present invention. However, they will be understood to be merely illustrative and not to limit the invention in any manner. The parts are by weight.

EXAMPLE 1

Finely divided RDX was coated with glycerol as follows: 7 parts of RDX (class 1, nominal particle size about 200 microns) were mixed with a solution of 0.5 part of glycerol in about 10 parts of acetone, after which the acetone was removed by evaporation.

The glycerol coated RDX thus obtained (7.5 parts) and 2 parts of methyl methacrylate monomer (distilled to removed added stabilizing inhibitor) were placed in separate arms of an apparatus which was evacuated and sealed. The methyl methacrylate was then added to the coated RDX under vacuum by tilting the apparatus, and the coated RDX particles were allowed to soak in the liquid monomer for several hours at ambient temperature. The mixture produced in this manner as free from oxygen and chemical inhibitor which would slightly retard the polymerization process.* The mixture was then exposed at ambient temperature to a radiation dose of about half a megarad from an industrial x-ray machine (~40 kv x-rays, ~24 ma beam current). The product thus obtained was an excellent, extremely hard solid composed of RDX particles in a rigid matrix of polymerized methyl methacrylate.

*The process of this invention can be also carried out in the presence of oxygen and small amounts of stabilizing inhibitor in the monomer. In such cases, larger radiation doses would be necessary to achieve the polymerization.

When the experiment was carried out under the foregoing conditions except that uncoated RDX particles were employed in place of glycerol coated RDX particles, the monomethyl methacrylate could not be polymerized. Other attempts to polymerize the monomethyl methacrylate in mixtures with uncoated RDX particles by means of radiation with x-rays or gamma rays, were unsuccessful.

EXAMPLE 2

The procedure described in example 1 was repeated using ethylene glycol in place of glycerol. A similar, extremely hard solid composed of RDX particles in a rigid matrix of polymerized methyl methacrylate was obtained.

The foregoing disclosure is merely illustrative of the principles of this invention and is not to be interpreted in a limiting sense. I wish it to be understood that I do not desire to be limited to the exact details of construction shown and described because obvious modifications will occur to a person skilled in the art.

I claim:

1. A process for producing a polymer bonded nitramine explosive or propellant composition by radiation polymerization of a polymer precursor in mixture with a particulate nitramine component which inhibits or retards such radiation polymerization, which comprises coating the nitramine particles with an effective amount of a liquid polyhydric alcohol for overcoming the action of the nitramine to inhibit or retard such radiation polymerization.

2. A process according to claim 1, wherein the nitramine component is at least one material of the group consisting of 1,3,5-trinitro-1,3,5-triazacyclohexane and 1,3,5,7-tetranitro-1,3,5,7-tetraazacyclooctane.

3. A process according to claim 1, wherein the precursor is at least one monomer of the group consisting of acrylate esters and methacrylate esters.

4. A process according to claim 1, wherein the polyhydric alcohol is selected from the group consisting of glycerol, ethylene glycol, propylene glycol, butylene glycol, polyethylene glycol, polypropylene glycol, polybutylene glycol and mixtures thereof.

5. A process according to claim 4, wherein the polyhydric alcohol is glycerol.

6. A process according to claim 1, wherein the nitramine particles are coated with up to about 10% by weight of the polyhydric alcohol.

7. A process according to claim 1, wherein the radiation is x-rays or gamma rays.

8. A process according to claim 1, wherein the mixture comprises about 75 to 95 parts by weight of the coated nitramine and about 5 to 25 parts by weight of polymer precursor.

9. A process according to claim 1, wherein the amount of liquid polyhydric alcohol is up to about 10% by weight of the nitramine particles.

* * * * *